US005842960A

United States Patent [19]

Yu

[11] Patent Number: 5,842,960

[45] Date of Patent: Dec. 1, 1998

[54] STRETCH MACHINE

[76] Inventor: Thomas Chun Yu, 416 Kitty Hawk Rd., Alameda, Calif. 94501

[21] Appl. No.: 716,778

[22] Filed: Sep. 24, 1996

Related U.S. Application Data

[60] Provisional application No. 60/004,467 Sep. 28, 1995.

[51] Int. Cl.[6] ..... A63B 21/00

[52] U.S. Cl. ..... 482/131; 482/42; 482/91; 482/141; 482/145; 482/907; 482/908

[58] Field of Search ..... 482/36, 37, 41, 482/42, 91, 131, 139, 141, 145, 148, 907, 908; 602/24; 297/466

[56] References Cited

U.S. PATENT DOCUMENTS

| | | | |
|---|---|---|---|
| 1,471,465 | 10/1923 | Hinton | 482/36 |
| 3,540,724 | 11/1970 | Hunter . | |
| 3,947,023 | 3/1976 | Martin | 482/142 |
| 3,966,200 | 6/1976 | Kirk | 482/131 |
| 4,277,062 | 7/1981 | Lawrence . | |
| 4,282,868 | 8/1981 | Riggs . | |
| 4,403,773 | 9/1983 | Swann | 482/145 |
| 4,456,247 | 6/1984 | Ehrenfried . | |
| 4,781,373 | 11/1988 | Irwin | 482/131 |
| 4,877,239 | 10/1989 | Dela Rosa . | |
| 5,147,266 | 9/1992 | Ricard | 482/907 |
| 5,366,427 | 11/1994 | Price, II | 482/148 |

FOREIGN PATENT DOCUMENTS

| | | | |
|---|---|---|---|
| 2592312 | 7/1987 | France | 482/41 |

*Primary Examiner*—Richard J. Apley
*Assistant Examiner*—Victor K. Hwang
*Attorney, Agent, or Firm*—Richard C. Litman

[57] ABSTRACT

An exercise and stretch device constructed of semi-flexible tubing. The exercise and stretch device of the present invention has a rectangular frame disposed between a pair of axially aligned and oppositely extending tubular extensions each with an angular leg support depending therefrom which are adapted to receive the legs of the user. The rectangular frame has a pair of U-shaped handle supports connected perpendicular to the plane of the frame which can be used to support the weight of the user during stretching exercises. The handle supports can be removed depending on the exercise being performed or to allow the user to easily position himself or herself on the stretch machine. The present invention also includes an optional back support member which can be used without the handle supports or in combination with the handle supports. A second embodiment of the present invention allows the user to adjust the size of the various members of the stretch machine depending on the size of the user and the difficulty level of the stretches being performed.

7 Claims, 6 Drawing Sheets

STRETCH MACHINE

BACKGROUND OF THE INVENTION

CROSS REFERENCE TO RELATED APPLICATION

This application claims the benefit of provisional application Ser. No. 60/004,467, filed on Sept. 28, 1995.

1. Field of the Invention

The present invention relates to exercise and stretch devices constructed of semi-flexible tubing. More specifically, the invention relates to a device which can be used to stretch the legs of an athlete including a rectangular frame having a pair of inverted U-shaped handles and a pair of leg-holding supports attached to the frame and extending to the sides of the frame.

2. DESCRIPTION OF PRIOR ART

Good agility in the limbs is of vital importance in all physical pursuits such as the martial arts, gymnastics, dance, and aerobics. In the martial arts, good flexibility of the legs can assist in faster kicks and evasive moves. Improved flexibility also reduces the time required for warming up before achieving high kicks and splits. It is extremely important for all athletes to thoroughly stretch prior to exercising in order to prevent injury to the muscles.

Several leg muscle stretching devices have been developed in the past, but all of these devices lack the versatility and effectiveness of the present invention. Many of these devices lack the ability to adjust in accordance with the user's bodily dimensions or desired level of stretching. Many of the devices developed in the past are bulky pieces of machinery and therefore cannot be quickly disassembled and easily transported from place to place. They also tend to be complex in design and have several moving parts and, therefore, tend to be expensive to manufacture and maintain.

U.S. Pat. No. 3,540,724, issued on Nov. 17, 1970, to William D. Hunter, discloses a multipositionable frame having a pair of tubular base members, a pair of U-shaped bars attachable to the base members, and an elastomeric band. The base members interconnect with the bars in a variety of positions so as to promote the exercising of different muscle groups. The elastomeric band can be attached to the device to further the complexity of exercises. Unlike the present invention, however, Hunter's device does not have any means for allowing adjustment of its height, length, and width. Further, Hunter's device does not allow the range of exercises of the present invention.

U.S. Pat. No. 4,277,062, issued on Jul. 7, 1981, to Mark Lawrence, discloses a frame and pulley system having a backrest, handles, and stirrups. Unlike the present invention, Lawrence's device is not easily portable because it consists of more than just tubular members. Furthermore, Lawrence's device does not allow a wide range of exercises as does the present invention. Lawrence's device also has several moving parts which will have to be replaced over time due to wear and tear.

U.S. Pat. No. 4,282,868, issued on Aug. 11, 1981, to Dean D. Riggs discloses a traction device having two portions which are pivotally secured together. One of the portions is U-shaped and adapted to be attached to one portion of a patient's body, such as the feet, and the other portion which is adapted to be attached to an opposite portion of the patient's body being pivotally secured to the outer ends of the side members defining the U-shaped portion. Rigg's device offers relatively few exercise positions in comparison to the present invention. Moreover, Rigg's device necessitates a pivoting action to accomplish its function, thereby making the device more likely to require maintenance.

U.S. Pat. No. 4,456,247, issued on Jun. 26, 1984, to Ted R. Ehrenfried discloses two leg supporting members which are independently pivotally connected to a base assembly. A cable connection and crank assembly force the legs of a user into a "split" position. Unlike the present invention, Ehrenfried's device is not a tubular framework and is not height, length, and width adjustable. Furthermore, Ehrenfried's device is bulky and complex in design.

U.S. Pat. No. 4,877,239, issued on Oct. 31, 1989, to Gregory Dela Rosa discloses a central spine having a seat bottom on one end and a pair of leg members mounted for free rotation on the opposing end. A pulley system moves the leg members with respect to a central handle disposed atop the central spine. Unlike the present invention, Rosa's device employs a complex pulley mechanism in combination with a handle and leg members. Furthermore, Rosa's device is not height, length, and width adjustable.

None of the above inventions and patents, taken either singularly or in combination, is seen to describe the instant invention as claimed. Thus, a stretch machine solving the aforementioned problems is desired.

SUMMARY OF THE INVENTION

The present invention relates to exercise and stretch devices constructed of semi-flexible tubing. More specifically, the invention relates to a device having a rectangular frame disposed between a pair of axially aligned and oppositely extending tubular extensions each with an angular leg support depending therefrom which are adapted to receive the legs of the user. The rectangular frame has a pair of U-shaped handle supports connected perpendicular to the plane of the frame which can be used to support the weight of the user during stretching exercises. The handle supports can be removed depending on the exercise being performed or to allow the user to easily position himself on the stretch machine. The present invention also includes an optional back support member which can be used without the handle supports or in combination with the handle supports. A second embodiment of the present invention allows the user to adjust the size of the various members of the stretch machine depending on the size of the user and the difficulty level of the stretches being performed.

Accordingly, it is a principal object of the invention to provide a versatile stretching apparatus capable of allowing a wide range of exercising positions.

It is another object of the invention to provide a lightweight, portable and collapsible stretching apparatus.

It is a further object of the invention to provide a stretching apparatus which can be easily assembled and disassembled in a few minutes.

Still another object of the invention is to provide a readily adjustable stretching apparatus such that its height, length, and width dimensions can be varied in accordance with the user's bodily dimensions or desired level of stretching.

It is an object of the invention to provide improved elements and arrangements thereof in a stretch machine for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
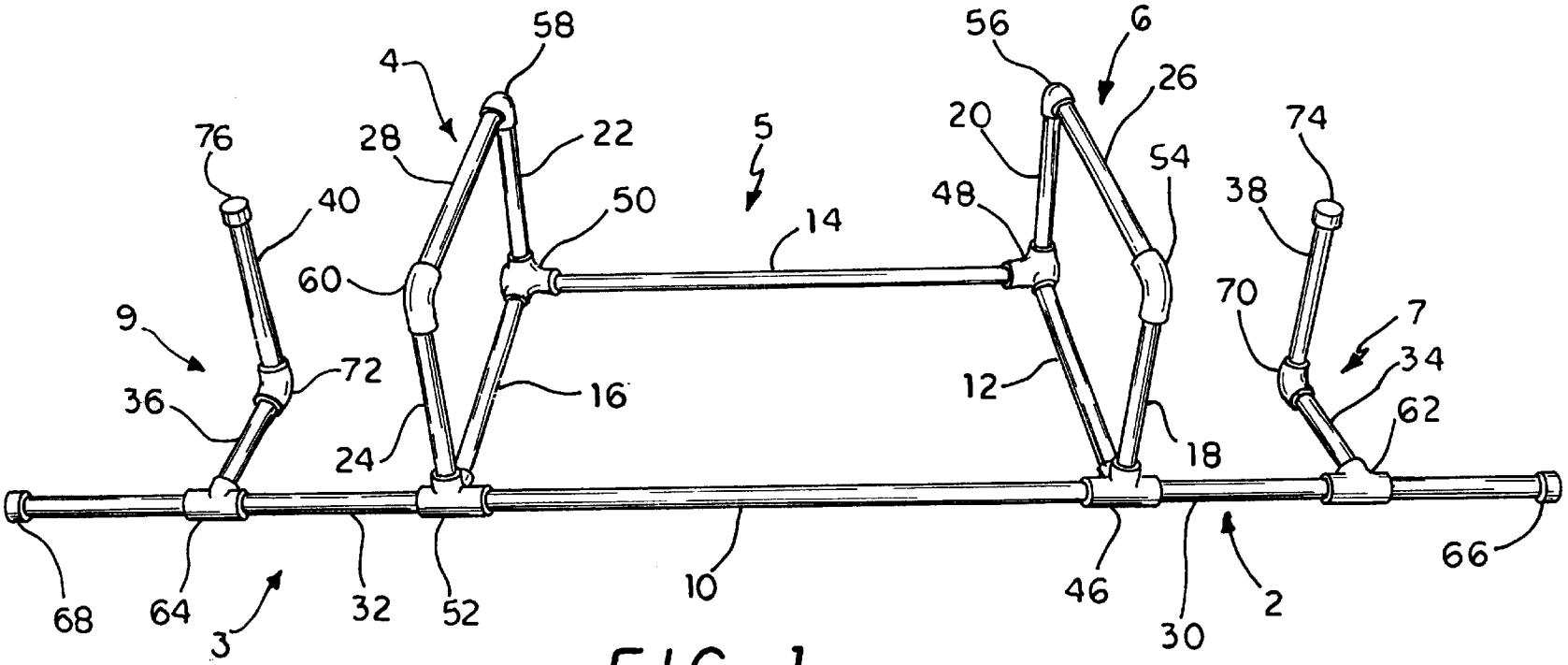
FIG. 1 is a front perspective view of the first embodiment of the stretch machine according to the present invention showing the adjustable leg supports.

The present invention improves over the prior art as illustrated in the drawings and hereinafter described. In FIG. 1, the present invention is shown in one embodiment as a rectangular frame 5 disposed between tubular extensions 2 and 3 such that angular leg supports 7 and 9 depend from tubular extensions 2 and 3. The rectangular frame 5 is composed of first longitudinal tubular member 10, second longitudinal tubular member 14, and side tubular members 12 and 16 which are interconnected via a series of joints 46, 48, 50, and 52. The rectangular frame 5 has a pair of U-shaped handle supports 4 and 6 connected thereto, which include tubular members 18, 20, 22, 24, 26, and 28 which are interconnected via a series of joints 46, 48, 50, 52, 54, 56, 58, and 60. Tubular extensions 2 and 3 are composed of tubular members 30 and 32 which are connected to the rectangular frame 5 by joints 46 and 52, respectively. The distal ends of tubular extension 2 is fitted with cap piece 66, and the distal end of tubular extension 3 is fitted with cap piece 68. Angular leg supports 7 and 9 are mounted on tubular members 30 and 32 by joints 62 and 64, respectively.

In one embodiment, the tubular members 10, 12, 14, 16, 18, 20, 22, 24, 26, 28, 30, 32, 34, 36, 38, and 40 are made of a tensile material such as polyvinyl chloride, while other embodiments utilize metals, such as aluminum, in place of polyvinyl chloride. Preferably, the joints 46, 48, 50, 52, 54, 56, 58, 60, 62, 64, 70, and 72 are friction fit onto tubular members 10, 12, 14, 16, 18, 20, 22, 24, 26, 28, 30, 32, 34, 36, 38, and 40 as shown in FIG. 1; however, all conventional means of attachment are contemplated such as threaded interconnection, adhesive fixation, and connection via screws or bolts. Joints 46, 48, 50, 52, 54, 56, 58, 60, 62, 64, 70, and 72 are conventional tubular fittings with either two or three orifices adapted to communicate with cylindrical type tubing, such as tubular members 10, 12, 14, 16, 18, 20, 22, 24, 26, 28, 30, 32, 34, 36, 38, and 40.

Tubular members 10, 12, 14, and 16 form the rectangular frame 5. Tubular member 10 is held relatively perpendicular to tubular members 12 and 16 by joints 46 and 52, respectively. In a similar fashion, tubular member 14 is held relatively perpendicular to tubular members 12 and 16 by joints 48 and 50, respectively. The right side U-shaped handle support 6 is partially formed by upright tubular members 18 and 20 which are held relatively upright and perpendicular to tubular member 12 by joints 46 and 48, respectively. Cross tubular member 26 is held perpendicular to upright tubular members 18 and 20 and parallel to tubular members 12 by joints 54 and 56. The left side U-shaped handle support 4 is partially formed by upright tubular members 22 and 24, cross tubular member 28 and joints 58 and 60 such that the left side is a mirror image of the right side.

Tubular extension 2 extends from joint 46, and tubular extension 3 extends from joint 52. Tubular members 30 and 32 are connected in-line and parallel to tubular member 10 by joints 46 and 52, respectively. Angular leg supports 7 and 9 are attached to tubular members 30 and 32 by joints 62 and 64, respectively. Joints 62 and 64 are adapted to adjustably slide along tubular members 30 and 32, respectively. To fix joints 62 and 64 in place along tubular members 30 and 32, respectively, all conventional means are contemplated. In one embodiment, screws (not shown) engage tubular members 30 and 32, respectively, to prevent movement of angular leg supports 7 and 9. Cap pieces 66 and 68 are mounted on tubular members 30 and 32 to guard against joints 62 and 64 from being slidably removed from tubular members 30 and 32.

With attention to angular or L-shaped leg support 7, base leg support member 34 is disposed relatively perpendicular to tubular member 30, and parallel to tubular member 12, by joint 62. Upstanding leg support member 38 is disposed relatively perpendicular to base leg support member 34, and parallel to tubular member 18, by joint 70. Cap piece 74 is mounted so as to form a closure at the tip of upstanding tubular member 38. Angular or L-shaped leg support 9 is a mirror image of angular leg support 7.

The present invention is multipurpose in both design and function. In one application, a user places one leg atop tubular member 12, the other leg atop tubular member 16, and his buttocks atop tubular member 14. Such placement of the user and his appendages distributes weight along tubular members 12, 14, and 16 of the rectangular frame 5 so as to anchor the present invention to the ground. The user preferably outstretches his legs so that the lower leg portions rest against angular leg supports 7 and 9. The placement of the user's legs against angular leg supports 7 and 9 is a stretching exercise in itself. Further, angular leg supports 7 and 9 serve to fix the user's legs in a preliminary outstretched position necessary for proper performance of other stretching exercises.

Figure 3:
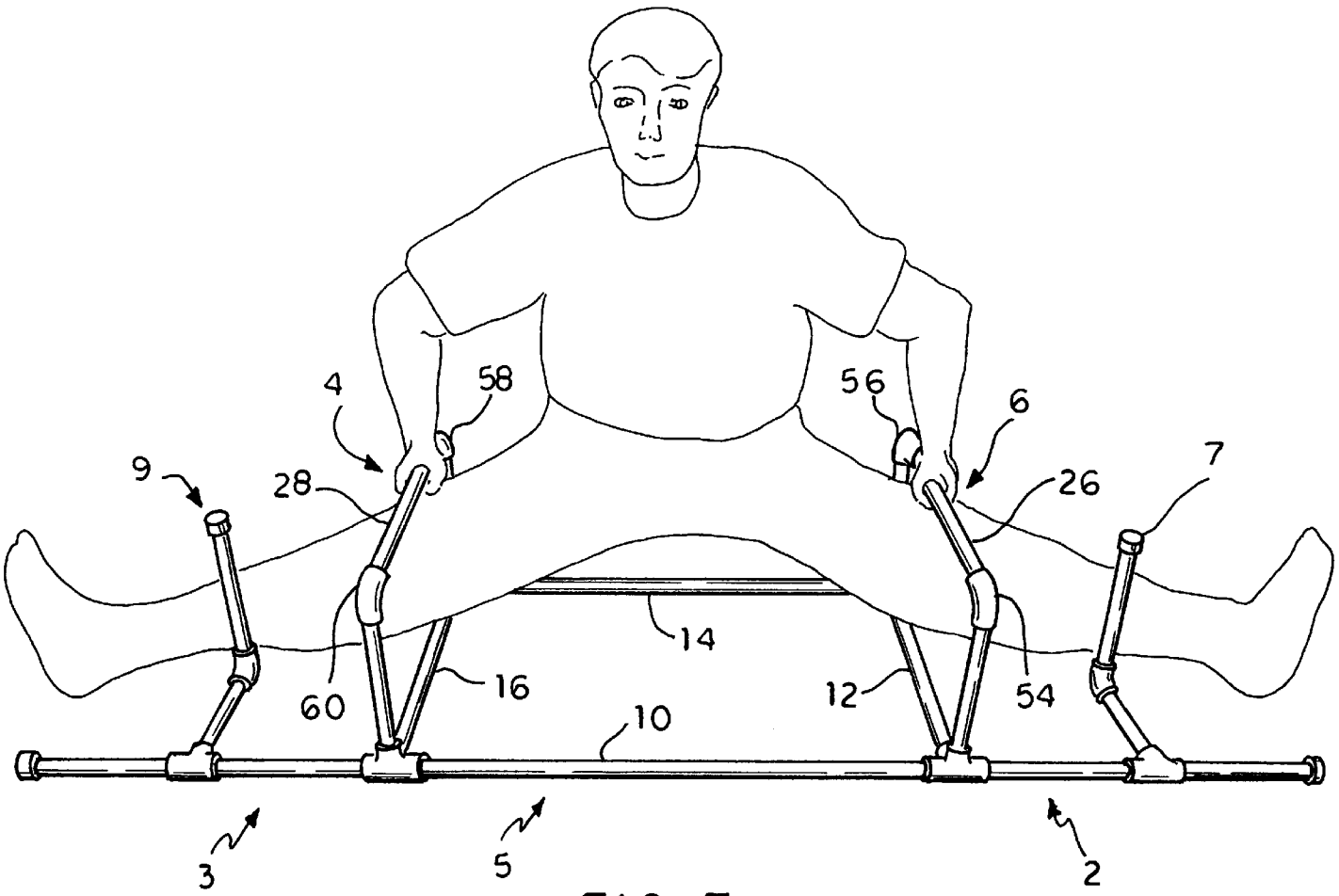
FIG. 3 is an environmental perspective view of the first embodiment of the present invention showing it in use.

From the seated position as described, the user can perform a variety of exercises. As shown in FIG. 3, in one embodiment, a user will grip handle support members 26 and 28 to hoist himself into the air during stretching exercises. The user's lower legs remain in contact with angular leg supports 7 and 9 such that angular leg supports 7 and 9 provide continued resistance to the user's legs. Thus, the user's natural tendency to allow his legs to move closer together is prevented and the proper stretching action is fully performed. Other exercises can be performed from the basic sitting position with legs outstretched. For example, the user can bend forward at his waist to move between joints 54 and 60. Alternatively, the user can bend backwards at his waist to move between joints 56 and 58. The present invention maximizes freedom of movement so that the user can further complicate exercises by holding onto various parts of the present invention's structure.

Figure 2:
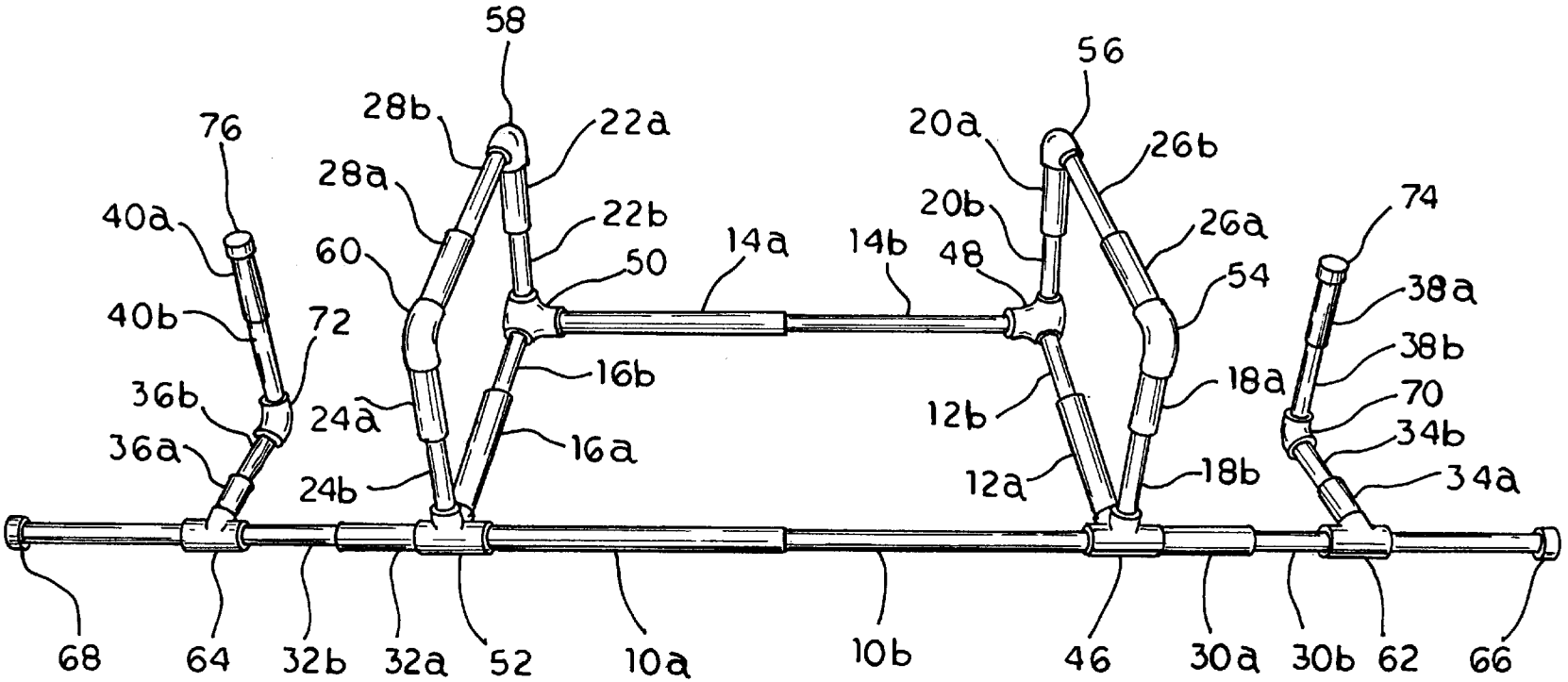
FIG. 2 is a front perspective view of the second embodiment of the present invention showing the adjustable framework and the adjustable leg supports.

In FIG. 2, a further embodiment of the present invention is shown wherein tubular members 12, 14, 16, 18, 20, 22, 24, 26, 28, 30, 32, 34, 36, 38, and 40 (as shown in FIG. 1) are replaced. In FIG. 1, tubular members 12, 14, 16, 18, 20, 22,

24, 26, 28, 30, 32, 34, 36, 38, and 40 are cylindrical and of a fixed length; in FIG. 2, tubular members 12A, 12B, 14A, 14B, 16A, 16B, 18A, 18B, 20A, 20B, 22A, 22B, 24A, 24B, 26A, 26B, 28A, 28B, 30A, 30B, 32A, 32B, 34A, 34B, 36A, 36B, 38A, 38B, 40A, and 40B are slidably interconnected such that 12B can slide into 12A, 14B can slide into 14A, etc., with a friction fit (as shown in FIG. 2) or with a conventional connection via screws or bolts (not shown). Alternatively, the larger diameter tubular members, such as 12A could be fitted with a series of holes (not shown) running the length thereof, while the smaller diameter tubular members, such as 12B, could be fitted with spring biased pins (not shown) which extend out of the smaller diameter tubular members and engage a selected hole, thereby fixing the length of the member. The second embodiment of the present invention, shown in FIG. 2, can be adjusted so that it suits the length, width, and height demands of the user. For example, leg support member 36B can be extended fully from 36A, and leg support member 34B can be extended fully from 34A, to force the user's legs farther apart.

Figure 6:
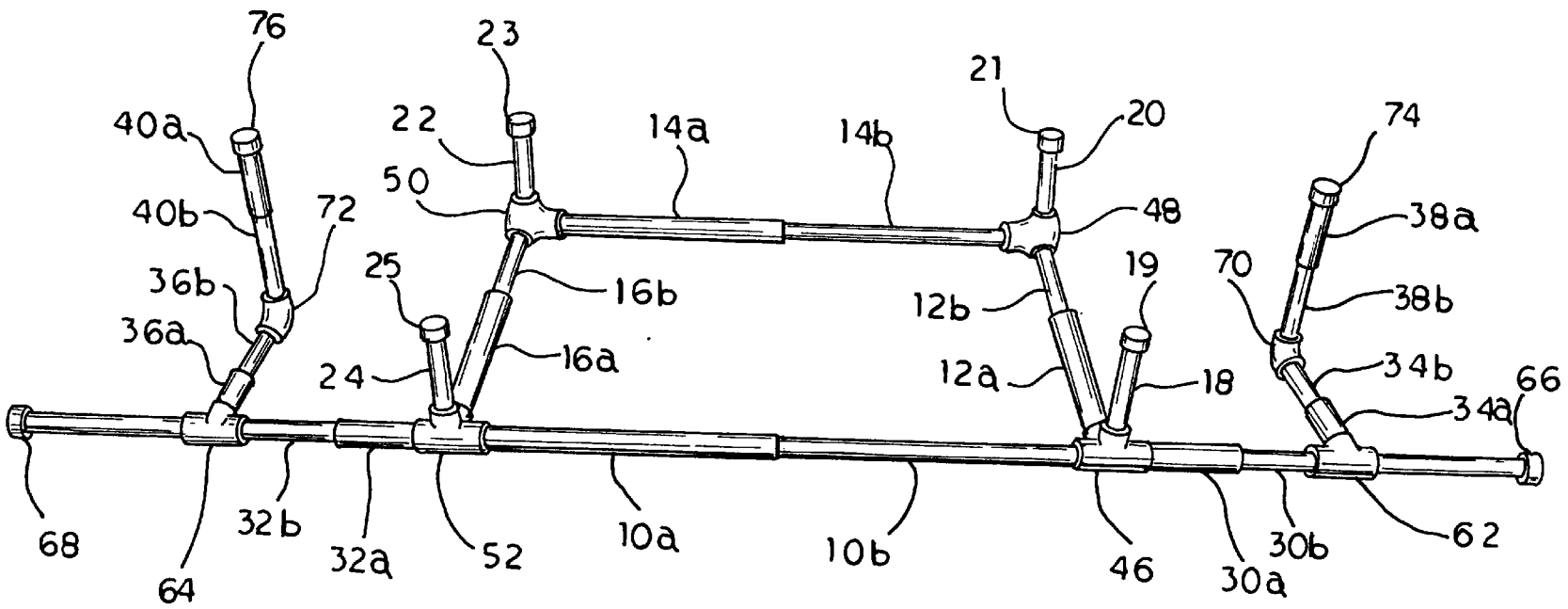
FIG. 6 is a front perspective view of a second embodiment of the present invention showing the adjustable framework and leg supports with the two handle supports removed and the optional back support removed.

For both the first and second embodiments, it is contemplated that part of the U-shaped handle supports 4 and 6 may be removed to allow the user to be seated in the stretch machine more easily. The handle supports 4 and 6 may either be replaced once the user is seated or left off during stretching. Joints 54, 56, 58, and 60 may be removed from tubular members 18, 20, 22, and 24, respectively, to allow the user to be seated without interference from tubular members 26 and 28. Caps 19, 21, 23, and 25 may be placed on the terminal ends of tubular members 18, 20, 22, and 24 respectively. FIG. 6 shows the second embodiment of the present invention with the handle supports removed. When the handle supports 4 and 6 are removed the user may perform a wider variety of stretching exercises to the sides without any interference from the handle supports.

Figure 4:
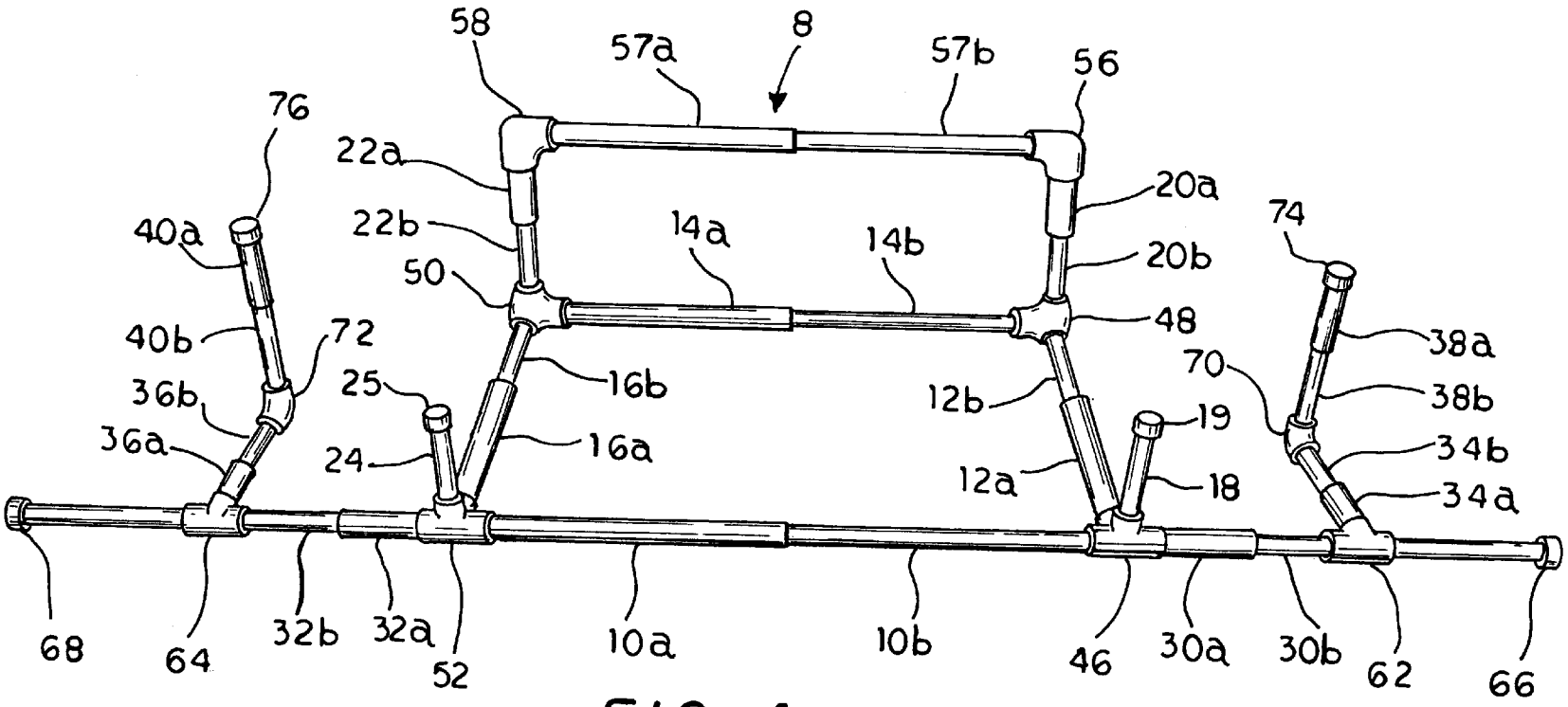
FIG. 4 is a front perspective view of the second embodiment of the present invention showing the adjustable framework and leg supports with the two upper handle supports removed and the optional back support in place.

FIG. 4 shows the second embodiment of the present invention with the U-shaped handle supports 4 and 6 removed and an additional back support 8 in place which comprises vartical tubular members 20A, 20B, and 22A, 22B, horizontal member 57A, 57B and joints 56 and 58. Tubular members 18 and 24 can be used as grips during stretching exercises. The back support 8 can also be used on the first embodiment in a similar manner (not shown) . The back support 8 can be used to maintain the user's back in a fixed position. The user may also use the back support 8 as a means of lifting his or her body up or lower it down during stretching exercises.

Figure 5:
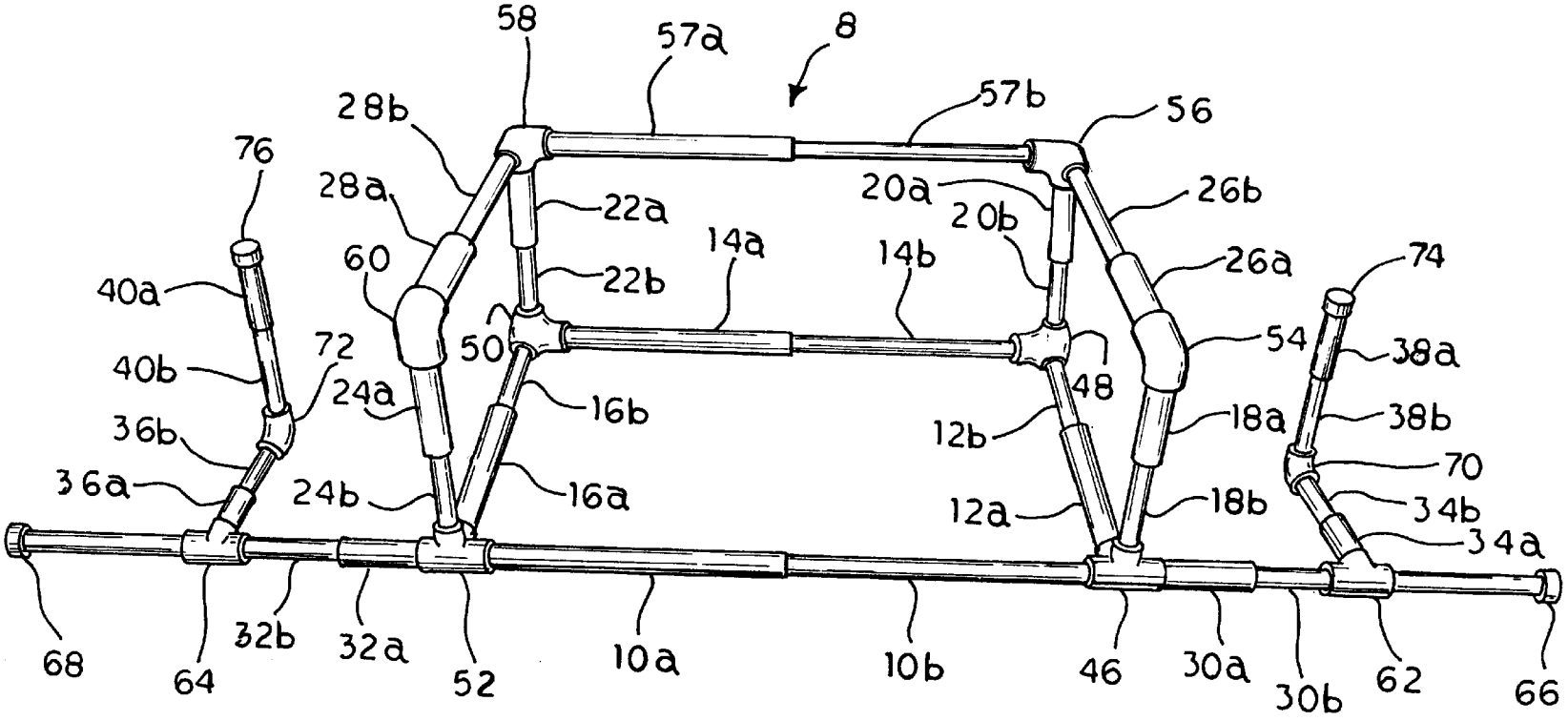
FIG. 5 is a front perspective view of a second embodiment of the present invention showing the adjustable framework and leg supports with the two handle supports and the optional back support in place.

Furthermore, the back support 8 may be used in combination with the U-shaped handle supports by simply making joints 56 and 58 conventional three orifice tubular fittings rather than two orifice tubular fittings, as shown in FIG. 5 for the second embodiment. Then the back support 8 could be held between joints 56 and 58 in a substantially parallel orientation to tubular member 14. The same configuration can be used on the first embodiment of the present invention (not shown).

It is to be understood that the present invention is not limited to the embodiments described above, but encompasses any and all embodiments within the scope of the following claims.

I claim:

1. A stretch machine comprising:

a rectangular frame including a first longitudinal tubular member having a first end and an opposite second end, a second longitudinal tubular member having opposing ends, and two side tubular members;

a first tubular extension connected to said first end of the first longitudinal tubular member and disposed in-line with said first longitudinal tubular member;

a second tubular extension connected to said second end of the first longitudinal tubular member and disposed in-line with said first longitudinal tubular member;

a first L-shaped leg support member including a first upstanding tubular member and a first base tubular member perpendicularly connected to said first upstanding member, said first base member perpendicularly connected to said first tubular extension and extending in a plane parallel to said side members and said first base tubular member shorter in length than said side tubular members; and a second L-shaped leg support member including a second upstanding tubular member and a second base tubular member perpendicularly connected to said second upstanding member, said second base member perpendicularly connected to said second tubular extension and extending in a plane parallel to said side members and said second base tubular member shorter in length than said side tubular members.

2. The stretch machine as defined in claim 1, further comprising an inverted U-shaped back support including vertical tubular members and a horizontal tubular member perpendicularly connected to each of said vertical tubular members, said vertical members upwardly extending from and perpendicularly connected to the respective opposing ends of said second longitudinal tubular member, said horizontal tubular member being spaced above and parallel to said second longitudinal tubular member of the rectangular frame.

3. The stretch machine as defined in claim 2, further comprising telescoping tubular members to form said rectangular frame, said first and second tubular extensions, said first and second L-shaped leg supports, and said back support.

4. A stretch machine comprising:

a rectangular frame including a first longitudinal tubular member having a first end and an opposite second end, a second longitudinal tubular member having opposing ends, a first side tubular member having opposing ends and a second side tubular member having opposing ends;

a first inverted U-shaped handle support including first upright tubular members and a first cross tubular member, said first upright members perpendicularly connected to respective opposing ends of said first side tubular member, said first cross tubular member perpendicularly connected to said first upright members and parallel to said first side member;

a second inverted U-shaped handle support including second upright tubular members and a second cross tubular member, said second upright members perpendicularly connected to respective opposing ends of said second side tubular member, said second cross tubular member perpendicularly connected to said second upright members and parallel to said second side member;

a first tubular extension connected to the first end of said first longitudinal member and disposed in-line with said first longitudinal member;

a second tubular extension connected to said second end and disposed in-line with said first longitudinal tubular member;

a first L-shaped leg support member including a first upstanding tubular member and a first base tubular member perpendicularly connected to said first upstanding member, said first base member perpendicularly connected to said first tubular extension and extending in a plane parallel to said side members and said first base tubular member shorter in length than said side tubular members; and a second L-shaped leg support member including a second upstanding tubular member and a second base tubular member perpendicularly connected to said second upstanding member, said second base member perpendicularly connected to said second tubular extension and extending in a plane parallel to said side members and said second base tubular member shorter in length than said side tubular members.

5. The stretch machine as defined in claim 4, further comprising an inverted U-shaped back support including vertical tubular members and a horizontal tubular member perpendicularly connected to each of said vertical tubular members, said vertical members upwardly extending from and perpendicularly connected to the respective opposing ends of said second longitudinal tubular member, said horizontal tubular member being spaced above and parallel to said second longitudinal tubular member of the rectangular frame.

6. The stretch machine as defined in claim 5, further comprising telescoping tubular members to form said rectangular frame, said first and second handle supports, said first and second tubular extensions, said first and second L-shaped leg supports, and said back support.

7. The stretch machine as defined in claim 4, wherein said first and second inverted U-shaped handle supports are removably connected to said rectangular frame.

* * * * *